United States Patent [19]

Hirooka et al.

[11] Patent Number: 4,855,210

[45] Date of Patent: Aug. 8, 1989

[54] ELECTROPHOTOGRAPHIC PHOTOSENSITIVE MEMBER, PROCESS AND APPARATUS FOR THE PREPARATION THEREOF

[75] Inventors: Masaaki Hirooka, Toride; Shunichi Ishihara, Ebina; Junichi Hanna; Isamu Shimizu, both of Yokohama, all of Japan

[73] Assignee: Canon Kabushiki Kaisha, Tokyo, Japan

[21] Appl. No.: 940,499

[22] Filed: Dec. 10, 1986

[30] Foreign Application Priority Data

Dec. 11, 1985 [JP] Japan ..... 60-277003

[51] Int. Cl.[4] ..... G03G 5/05

[52] U.S. Cl. ..... 430/133; 430/128

[58] Field of Search ..... 427/255.1, 255.2; 430/128, 133

[56] References Cited

U.S. PATENT DOCUMENTS

| | | | |
|---|---|---|---|
| 4,397,933 | 8/1983 | Sugata et al. | 430/133 |
| 4,501,777 | 2/1985 | Rose | 427/255.2 |
| 4,532,199 | 7/1985 | Ueno et al. | 430/133 |
| 4,609,562 | 9/1986 | Isenberg et al. | 427/255.2 |
| 4,624,906 | 11/1986 | Kawamura et al. | 430/128 |

*Primary Examiner*—John L. Goodrow

*Attorney, Agent, or Firm*—Fitzpatrick, Cella, Harper & Scinto

[57] ABSTRACT

An improved electrophotographic photosensitive member having a desired light receiving layer prepared by the use of a substance capable of contributing to form a deposited film and an electronically oxidizing agent in the absence of a plasma. A process and an apparatus for preparing the electrophotographic photosensitive member.

22 Claims, 5 Drawing Sheets

ELECTROPHOTOGRAPHIC PHOTOSENSITIVE MEMBER, PROCESS AND APPARATUS FOR THE PREPARATION THEREOF

FIELD OF THE INVENTION

This invention relates to an improved electrophotographic photosensitive member using an amorphous material, a process and an apparatus for preparing the same.

BACKGROUND OF THE INVENTION

There have been proposed a number of electrophotographic photosensitive members having a light receiving layer composed of a non-crystalline material containing silicon atoms as the main component, the so-called amorphous silicon (hereinafter referred to as "a-Si") disposed on a substrate.

And there have been proposed various methods for the preparation of such light receiving layer for the electrophotographic member using vacuum evaporation technique, heat chemical vapor deposition technique, plasma chemical vapor deposition technique, reactive sputtering technique, ion plating technique and light chemical vapor deposition technique.

Among those methods, the method using plasma vapor deposition technique (hereinafter referred to as "plasma CVD method") has been generally recognized as being the most preferred and is currently used to manufacture said light receiving layer.

However, for any of the known light receiving layers, even if an acceptable one is obtained by plasma CVD method and that exhibits almost satisfactory characteristics, there still remain problems unsolved in satisfying totally the points for its characteristics, particularly electric and optical characteristics, photoconductive characteristics, deterioration resistance upon repeating use and use-environmental characteristics. Other points relating to its homogeneity, reproducibility and mass-productivity and further points relating to its lasting stability and durability, are required to be satisfied for the photoelectric conversion layer to be a durable one.

The reasons are largely due to the fact that the light receiving layer can not be easily prepared by a simple layer deposition procedure but skill is are required in the process operations in order to obtain a desirable light receiving layer while having due regards for the starting materials.

For example, in the case of forming a film composed of an amorphous silicon material (hereinafter referred to as "a-Si") according to heat chemical vapor deposition technique (hereinafter referred to as "CVD method"), after the gaseous material containing silicon atoms being diluted, appropriate impurities are introduced thereinto and the thermal decomposition of related materials is carried out at an elevated temperature between 500° and 650° C.

Therefore, in order to obtain a desirable a-Si film by CVD method, precise process operation and control are required, and because of this, the apparatus in which the process according to CVD method is practiced will be eventually complicated and costly.

However, even in that case, it is extremely difficult to stably obtain a desirable light receiving layer composed of an a-Si material having abundant practically applicable characteristics on an industrial scale.

Now, although the plasma CVD method is widely used nowadays as above mentioned, it is still accompanied with problems relating to process operations and to facility investment.

Regarding the former problems, the operation conditions to be employed under the plasma CVD method are much more complicated than the known CVD method, and it is extremely difficult to generalize them.

That is, there already exist a number of variations even in correlated parameters concerning the temperature of a substrate, the amount and the flow rate of gases to be introduced, the degree of pressure and the high frequency power for forming a layer, the structure of an electrode, the structure of a reaction chamber, the flow rate of gases to be exhausted, and the plasma generation system. Besides said parameters, there also exist other kinds of parameters. Under these circumstances, in order to obtain a desirable deposited film product it is required to choose precise parameters from a great number of varied parameters. And sometimes serious problems occur. For instance, because of the precisely chosen parameters, a plasma is apt to be in an unstable state which invites problems in a deposited film to be formed.

And for the apparatus in which the process using the plasma CVD method is practiced, its structure will be eventually complicated since the parameters to be employed are precisely chosen as above stated. Whenever the scale or the kind of the apparatus to be used is modified or changed, the apparatus must be so structured as to cope with the precisely chosen parameters.

In this regard, even if a desirable deposited film should be fortuitously mass-produced, the film product becomes unavoidably costly because (1) a heavy investment is firstly necessitated to set up a particularly appropriate apparatus therefor; (2) a number of process operation parameters even for such apparatus still exist and the relevant parameters must be precisely chosen from the existing various parameters for the mass-production of such film. In accordance with such precisely chosen parameters, the process must then be carefully practiced.

Against this background, an electrophotographic photosensitive member has become diversified nowadays. And there is an increased demand to stably provide a relatively inexpensive electrophotographic photosensitive member having a light receiving layer with a normal square measure or a large square measure composed of an a-Si material which has a relevant uniformity and many applicable characteristics and which is suited for the use purpose and the application object.

Consequently, there is an earnest desire to develop an appropriate method and apparatus to satisfactorily meet the above demand.

Likewise, there is a similar situation which exists with respect to other kinds of non-monocrystalline light receiving layers for electrophotographic photosensitive member, for example, those composed of an a-Si material containing at least one kind selected from oxygen atoms, carbon atoms and nitrogen atoms [hereinafter referred to as "a-Si(H,X)(O,C,N)"].

SUMMARY OF THE INVENTION

The present inventors have conducted extensive studies in order to solve the problems in the aforementioned known methods and in order to develop a new process for effectively and simply preparing an improved electrophotographic photosensitive member having a desirable light receiving layer composed of a non-crystalline semiconducting material, which has a wealth of practically applicable characteristics, without depending upon any known method and which meets the above-mentioned demands.

As a result, the present inventors finally have found a process that enables one to efficiently and stably prepare said electrophotographic photosensitive member in simplified particular procedures as detailed below.

It is therefore an object of this invention to provide an improved electrophotographic photosensitive member provided with a desirable light receiving layer composed of a non-crystalline material which has many practically applicable characteristics and brings about excellent electrophotographic functions, and which is prepared without depending upon plasma reaction.

Another object of this invention is to provide a process for preparing the improved electrophotographic photosensitive member by which the light receiving layer can be mass-produced with simplified film forming conditions in a film forming space without plasma discharge while maintaining the characteristics of the film to be formed and promoting the film-forming rate.

A further object of this invention is to provide an apparatus suitable for practicing the present process.

These and other objects, as well as the features of this invention will become apparent by reading the following descriptions of preferred embodiments according to this invention while referring to the accompanying drawings.

BRIEF DESCRIPTION OF THE DRAWINGS

FIG. 1(A) through FIG. 1(E) are schematic portion views for illustrating representative embodiments of an electrophotographic photosensitive member according to this invention, in which FIG. 1(A) is a cross-sectional view of a first representative embodiment of an electrophotographic photosensitive member according to this invention;

FIG. 1(B) is a cross-sectional view of a second representative embodiment of an electrophotographic photosensitive member according to this invention;

FIG. 1(C) is a cross-sectional view of a third representative embodiment of an electrophotoelectric photosensitive member according to this invention;

FIG. 1(D) is a cross-sectional view of a fourth representative embodiment of an electrophotoelectric photosensitive member according to this invention;

FIG. 1(E) is a cross-sectional view of a fifth representative embodiment of an electrophotographic photosensitive member according to this invention.

FIGS. 2(A) through 2(C) are schematic diagrams of a representative apparatus for practicing the process for preparing an electrophotographic photosensitive member according to this invention, in which FIG. 2(A) is a schematic cross-sectional view of the apparatus; FIG. 2(B) is a schematic longitudinal-sectional view of the apparatus; and FIG. 2(C) is a schematic longitudinal-sectional view of the gas transporting conduit of the apparatus.

DESCRIPTION OF THE INVENTION

Figure 1A:
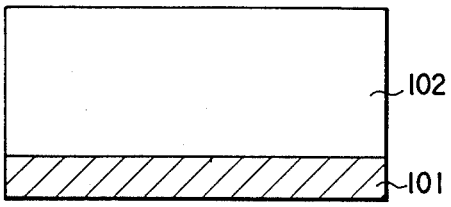

The present inventors have made earnest studies for overcoming the foregoing problems on the conventional electrophotographic photosensitive member and attaining the objects as described above and, as a result, have accomplished this invention based on the findings as described below.

That is, (i) a substance which can be a constituent for forming a photoelectric conversion layer but which does not or can hardly contribute to form said layer as long as it remains in its original energy state and (ii) another substance which can react with the substance (i) to electronically oxidize it (which means that the atom, ion or molecule of the substance loses an electron, namely the oxidation number is increased) were selected, and the two substances (i) and (ii) in gaseous state were separately introduced through respective transporting passage into a film forming space wherein a substrate for the electrophotographic photosensitive member being maintained at about 300° C. is placed to thereby let the two substances (i) and (ii) collide and contact to cause a mutual reaction among the two substances (i) and (ii) in the space positioned over the substrate in the film forming space.

As a result, there was formed a homogeneous deposited film with a uniform thickness without accompaniment of any solid particle on the substrate. And it was found that the resulting deposited film has a plethora of electric and optical properties and is uniformly accompanied by excellent electrophotographic functions.

An electrophotographic photosensitive member prepared in accordance with the above procedures exhibited a light receiving layer abundant in practical applicable characteristics such as electric and optical characteristics, deterioration resistance upon repeating use and use-environmental characteristics and which has an excellent electrophotographic function. As a result, it was confirmed that this method is of a sufficient repeatability.

This invention has been completed based on these findings, and it includes an improved electrophotographic photosensitive member, a process and an apparatus for preparing the same.

That is, according to one aspect of this invention, there is provided an improved electrophotographic photosensitive member comprising a substrate for electrophotography and a light receiving layer disposed on the surface of the substrate, the light receiving layer being a layer which was formed by introducing (i) a substance which can be a constituent for forming a deposited film but which does not or can hardly contribute to form said film as long as it remains in its original energy state (hereinafter referred to as "substance A") in gaseous state and a gaseous substance having a property to electronically oxidize the substance (hereinafter referred to as "oxidizing agent") separately through respective gas transporting space into a film forming space wherein the substrate is placed while being maintained at predetermined temperature, making the two substances contact each other in the absence of a plasma in the space positioned above the surface of the substrate to thereby generate plural kinds of precursors containing excited precursors and let at least one kind of those precursors the directed to form said film.

According to another aspect of this invention, there is provided a process for preparing an improved electrophotographic photosensitive member, characterized; (a)

employing together a gaseous substance A and a gaseous oxidizing agent, (b) passing the gaseous substance A through a transportation space leading a film forming space wherein a substrate for electrophotography is placed while being maintained at a predetermined temperature, (c) passing the gaseous oxidizing agent through the other transportation space leading to the film forming space and (d) contacting the substance A and the oxidizing agent in the absence of a plasma in the space positioned above the surface of the substrate to thereby generate plural kinds of precursors containing excited precursors and let at least one kind of those precursors be directed to form a deposited film to be a light receiving layer for said electrophotographic photosensitive member.

According to a further aspect of this invention, there is provided an apparatus suitable for practicing the above process which comprises a double conduit having an outer passage for the gaseous oxidizing agent and an inner passage for the gaseous substance A and a film forming chamber having a supporting means for a substrate for the electrophotographic photosensitive member.

According to this invention, there can be obtained a desirable light receiving layer for the electrophotographic photosensitive member in the absence of a plasma without having any influence of plasma etching or any problem due to abnormal discharge actions since the process does not depend upon the conventional plasma CVD method using a gaseous plasma formed by subjecting the starting gaseous materials to the action of a discharge energy.

In addition, according to this invention, there are provided the following advantages; a desirable light receiving layer for an electrophotographic photosensitive member having a uniform thickness and a desirable homogeneity may be effectively formed at an improved film forming rate in simple procedures without consumption of so much energy as in the conventional plasma CVD method; the operation parameters for preparing a light receiving layer for an electrophotographic photosensitive member may be largely simplified; an improved electrophotographic photosensitive member having such desirable light receiving layer or if necessary, of a large square measure may be mass-produced on an industrial scale to thereby reduce the cost of a product; and such a heavy investment as much for the apparatus in the conventional plasma CVD method is not necessitated even in the case of setting up a particularly appropriate apparatus to practice the process of this invention.

DESCRIPTION OF THE PREFERRED EMBODIMENTS

Representative embodiments of the electrophotographic photosensitive member, the process and the apparatus for the preparation of the same according to this invention will now be explained more specifically referring to the drawings. The description is not intended to limit the scope of the invention.

The electrophotographic photosensitive members provided according to this invention are represented by those shown in FIGS. 1(A) through 1(F).

Figure 1B:
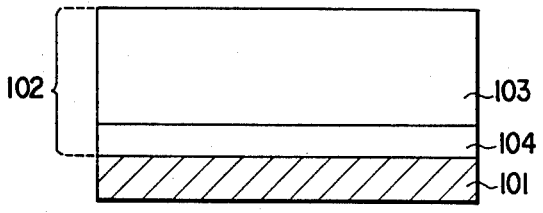
Figure 1C:
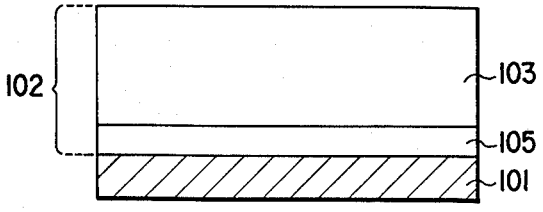
Figure 1D:
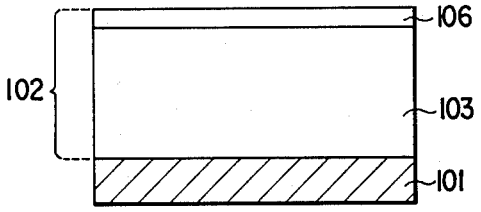
Figure 1E:
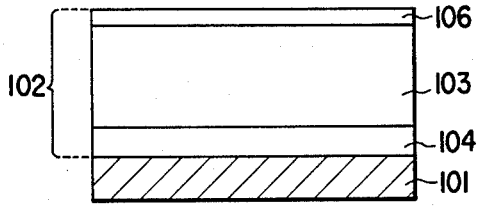
Figure 1F:
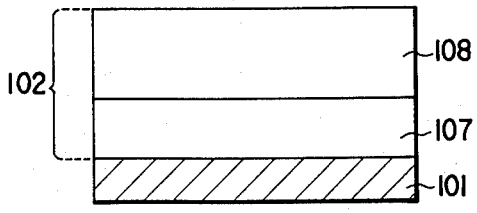
FIG. 1(F) is a cross-sectional view of a sixth representative embodiment of an electrophotographic photosensitive member according to this invention.

FIG. 1(A) is a cross-sectional view of a first representative embodiment of an electrophotographic photosensitive member according to this invention;

FIG. 1(B) is a cross-sectional view of a second representative embodiment of an electrophotographic photosensitive member according to this invention;

FIG. 1(C) is a cross-sectional view of a third representative embodiment of an electrophotoelectric photosensitive member according to this invention;

FIG. 1(D) is a cross-sectional view of a fourth representative embodiment of an electrophotoelectric photosensitive member according to this invention;

FIG. 1(E) is a cross-sectional view of a fifth representative embodiment of an electrophotographic photosensitive member according to this invention; and FIG. 1(F) is a cross-sectional view of a sixth representative embodiment of an electrophotographic photosensitive member according to this invention.

In any of the above electrophotographic photosensitive members, the substrate may be either electroconductive or electrically insulative.

The electroconductive substrate can include, for example, metals such as NiCr, stainless steel, Al, Cr, Mo, Au, Nb, Ta, V, Ti Pt, and Pb, or the alloys thereof.

The electrically insulative substrate can include, for example, film or sheet of synthetic resins such as polyester, polyethylene, polycarbonate, cellulose acetate, polypropylene, polyvinyl chloride, polyvinylidene chloride, polystyrene, and polyamide; glass, ceramics, and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_2$, $SnO_3$, ITO ($In_2O_3+SnO_2$), etc. In the case of the synthetic resin film such as polycarbonate film, the electroconductivity is provided to the surface by disposing a thin film of metal such as NiCr, Al, Ag, Pb, Zn, Ni, Au, Cr, Mo, Ir, Nb, Ta, V, Tl, and Pt by means of vacuum deposition, electron beam vapor deposition, sputtering, etc. or applying lamination with the metal to the surface. The substrate may be of any configuration such as cylindrical, belt-like or plate-like shape, which can be properly determined depending on the applications. For instance, it is desirably configured into an endless belt or cylindrical form in the case of continuous high speed production. The thickness of the substrate is properly determined so that the light receiving layer as desired can be formed. In the case where flexibility is required for the electrophotographic photosensitive member, it can be made as thin as possible within a range capable of sufficiently providing the function as the substrate. However, the thickness is usually greater than 10 μm in view of the fabrication and handling or mechanical strength of the support.

The first embodiment [FIG. 1(A)]

The electrophotographic photosensitive member comprises a single light receiving layer 102 disposed on the substrate 101.

The single light receiving layer 102 is composed of an a-Si material, preferably, an a-Si material containing, in addition to silicon atoms, at least one kind selected from hydrogen atoms (H) and halogen atoms (X) [hereinafter referred to as "a-Si(H,X)"].

The halogen atom (X) contained in the light receiving layer 102 include, specifically, fluorine, chlorine, bromine and iodine, fluorine and chlorine being particularly preferred. The amount of the hydrogen atoms (H), the amount of the halogen atoms (X) or the sum of the amounts for the hydrogen atoms and the halogen atoms (H+X) contained in the light receiving layer 102 is usually from 1 to 40 atm % and, preferably, from 5 to 30 atm %.

It is possible for the above light receiving layer 102 to further contain germanium atoms (Ge) and/or tin atoms (Sn).

In the case where the above light receiving layer 102 is composed of an a-Si(H,X) material containing germanium atoms (Ge) and/or tin atoms (Sn) [hereinafter referred to as "a-Si(Ge,Sn)(H,X)"], there is provided an improvement in the absorption spectrum characteristics in the long wavelength region of the light receiving layer.

That is, incorporating at least one kind selected from germanium atoms and tin atoms into the light receiving layer brings about a desired electrophotographic photosensitive member which is more sensitive to light of wavelengths broadly ranging from short wavelength to long wavelength covering visible light then quickly responsive to light. This effect becomes more significant when a semiconductor laser emitting ray is used as the light source.

The amount of germanium atoms and/or tin atoms in the light receiving layer 102 should be properly determined so that the object of the invention is effectively achieved. It is usually 1 to $6\times10^5$ atomic ppm, preferably 10 to $3\times10^5$ atomic ppm, and more preferably $1\times10^2$ to $2\times10^5$ atomic ppm.

It is also possible for the above light receiving layer 102 to contain a substance for controlling the conductivity.

As such substance, the so-called impurities in the field of semiconductora can be mentioned and those usable herein can include atoms belonging to the group III of the periodic table that provide p-type conductivity (hereinafter simply referred to as "group III atoms") or atoms belonging to the group V of the periodic table that provide n-type conductivity (hereinafter simply referred to as "group V atoms"). Specifically, the group III atoms can include B (boron), Al (aluminum), Ga (gallium), In (indium) and Tl (thallium), B and Ga being particularly preferred. The group V atoms can include, for example, P (phosphorus), As (arsenic), Sb (antimony), and Bi (bismuth), P and Sb being particularly preferred.

In the case where either the group III or the group V atoms are incorporated into the light receiving layer 102, there is provided an electrophotographic photosensitive member having a light receiving layer of which the type of conductivity and the conductivity are appropriately controlled.

The amount of either the group III or the group V in the light receiving layer 102 in that case is preferably from $1\times10^{-3}$ to $1\times10^3$ atomic ppm, more preferably, from $5\times10^{-2}$ to $5\times10^2$ atomic ppm, and, most preferably , from $1\times10^{-1}$ to $5\times10^2$ atomic ppm.

The second to sixth embodiments [FIG. 1(B) through FIG. 1(F)]

In any of these cases, the light receiving layer is of a multi-layered structure and has a photosensitive layer 103 as one of the constituent layers.

The photosensitive layer 103 may be the same as the light receiving layer 102 of the first embodiment as shown in FIG. 1(A).

That is, in the second to sixth embodiments shown in FIG. 1(B) through FIG. 1(F), the photosensitive layer 103 is composed of an a-Si(H,X) material or an a-Si(Ga,Sn)(H,X) material, if necessary, containing either the group III or the group V atoms.

Referring FIG. 1(B), the electrophotographic photosensitive member comprises the substrate 101 and a light receiving layer 102 constituted by a layer 104 containing a substance for controlling the conductivity and the photosensitive layer 103.

In this embodiment, the layer 104 contains a relatively large amount of the substance for controlling the conductivity, namely, either the group III or the group V atoms and functions as a charge injection inhibition layer.

That is, in the case of incorporating the group III or group V atoms in a uniformly distributed state to a portion of the layer region in contact with the support, or the atoms are contained such that the distribution density of the group III or group V atoms in the direction of the layer thickness is higher on the side adjacent to the support, the constituting layer containing such group III or group V atoms or the layer region containing the group III or group V atoms at high concentration function as a charge injection inhibition layer. That is, in the case of incorporating the group III atoms, movement of electrons injected from the side of the support into the photosensitive layer can effectively be inhibited upon applying the charging treatment of at positive polarity at the free surface of the photosensitive layer. While on the other hand, in the case of incorporation the group III atoms, movement of positive holes injected from the side of the support into the photosensitive layer can effectively be inhibited upon applying the charging treatment at negative polarity at the free surface of the layer. The content in this case is relatively great. Specifically, it is generally from 30 to $5\times10^4$ atomic ppm, preferably from 50 to $1\times10^4$ atomic ppm, and most suitably from $1\times10^2$ to $5\times10^3$ atomic ppm. Then, for the charge injection inhibition layer to produce the intended effect, the thickness (T) of the photosensitive layer and the thickness (t) of the layer or layer region containing the group III or group V atoms adjacent to the support should be determined such that the relation $t/T\leqq0.4$ is established. More preferably, the value for the relationship is less than 0.35 and, most suitably, less than 0.3. Further, the thickness (t) of the layer or layer region is generally $3\times10^{-3}$ to 10 $\mu$m, preferably $4\times10^3$ to 8 $\mu$m, and, most suitably, $5\times10^{-3}$ to 5 $\mu$m.

The distribution state of the group III or group V atoms and the amount of the group III or group V atoms are, of course, combined properly as required for obtaining the light receiving member having performances capable of attaining a desired purpose. For instance, in the case of disposing the charge injection inhibition layer at the end of the photosensitive layer on the side of the support, a substance for controlling the conductivity of a polarity different from that of the substance for controlling the conductivity contained in the charge injection inhibition layer may be contained in the photosensitive layer other than the charge injection inhibition layer, or a substance for controlling the conductivity of the same polarity may be contained by an amount substantially smaller than that contained in the charge inhibition layer.

Referring FIG. 1(C), the electrophotographic photosensitive member comprises the substrate 101 and a light receiving layer 102 constituted by an intermediate layer 105 containing at least one kind selected from oxygen atoms, carbon atoms and nitrogen atoms and the photosensitive layer 103.

In this embodiment, the intermediate layer 105 is composed of an a-Si(H,X) material containing at least one kind selected from oxygen atoms, carbon atoms and nitrogen atoms [hereinafter referred to as "a-Si(O,C,N)(H,X)"].

This is effective in increasing the photosensitivity and dark resistance of the light receiving layer and in improving adhesion between the substrate and the light receiving layer.

And, since the intermediate layer 105 is also effective in efficiently preventing inflow of photocarriers from the side of the substrate 101 into the photosensitive layer 103 and in promoting movement of the photocarriers, which are generated in the photosensitive layer 103 and moved toward the substrate 101, from the side of the photosensitive layer 103 toward the substrate 101, it functions as a barrier layer.

The amount of at least one kind selected from oxygen atoms, carbon atoms, and nitrogen atoms contained in the intermediate layer 105 is determined while considering the organic relationship such as the performance at the interface in contact with the substrate, in addition to the performance required for the light receiving layer, and it is preferably from 0.001 to 50 atomic %, more preferably, from 0.002 to 40 atomic %, and, most preferably, from 0.003 to 30 atomic %.

The thickness of the intermediate layer 105 is preferred to be less than 5 μm.

Further, the intermediate layer 105 may act to function as a charge injection inhibition layer by incorporating either the group III or the group V atoms thereinto.

Referring FIG. 1(D), the electrophotographic photosensitive member comprises the substrate 101 and a light receiving layer constituted by the photosensitive layer 103 and a surface layer 106 having a free surface.

In this embodiment, the surface layer 106 is composed of an a-Si(H,X) material containing at least one kind selected from oxygen atoms (0), carbon atoms (C) and nitrogen atoms (N) in a uniformly distributed state [hereinafter referred to as "a-Si(O,C,N)(H,X)"].

The surface layer 106 is disposed to the photosensitive layer 103 with an aim of improving the moisture-proofness, performance for continuous repeating use, electrical voltage withstanding property, circumstantial resistant property and durability, and these purposes can be attained by incorporating at least one kind selected from oxygen atoms, carbon atoms and nitrogen atoms in the amorphous material constituting the surface layer.

At least one kind selected from oxygen atoms, carbon atoms and nitrogen atoms are contained in a uniformly distributed state in the surface layer 106, by which the foregoing various properties can be improved in accordance with the increase in the content of such atoms. However, if the content is excessive, the layer quality is reduced and electrical and mechanism properties are also degraded. In view of the above, the amount of such atoms is preferably from 0.001 to 90 atm %, more preferably, from 1 to 90 atm. % and, most preferably, from 10 to 80 atm %.

The surface layer 106 has to be formed with an utmost care so as to obtain the properties as desired. That is, the state of the substance comprising silicon atoms, oxygen atoms and, further, hydrogen atoms and/or halogen atoms as the constituent atoms is from crystalline to amorphous state, the electrical property of the layer may vary from the conductive, to semiconductivity and insulating property and, further, the photoelectronical property of the layer may also vary from photoconductive to non-photoconductive property depending on the content of each of the constituents atoms and other conditions of preparation. Accordingly, it is essential to select the content for each of the constituents atoms and the preparation conditions such that the surface layer 106 having desired properties depending on the purpose can be formed.

For instance, in the case of disposing the surface layer 106 mainly for improving the electrical voltage withstanding property, the amorphous material constituting the surface layer 106 is formed such that it exhibits remarkable electrically insulating behaviors under the working conditions. Further, in the case of disposing the surface layer 106 mainly for improving the properties in the continuous repeating use or the circumstantial-resistant property, the amorphous layer constituting the surface layer 106 is formed such that the layer has a photosensitivity to some extent to the irradiated light, although the degree of the electrically insulating property is somewhat moderated.

The thickness of the surface layer is also one of the important factors for effectively attaining the purpose of this invention and it is properly determined depending on the desired purposes. It is, however, also necessary that the layer thickness is determined in view of relative and organic relationships in accordance with the amounts of the oxygen atoms, carbon atoms, nitrogen atoms, halogen atoms and hydrogen atoms contained in the layer or the properties required for the surface layer. Further, it should be determined also in economical point of view such as productivity or mass productivity. In view of the above, the thickness of the surface layer 106 is preferably from $3\times10^{-3}$ to 30μ, more preferably, from $4\times10^{-3}$ to 20μ and, most preferably, from $5\times10^{-3}$ to 10μ.

Referring FIG. 1(E), the electrophotographic photosensitive member comprises the substrate 101 and a light receiving layer 102 constituted by the charge injection inhibition layer 104, the photosensitive layer 103 and the surface layer 106.

Referring FIG. 1(F), the electrophotographic photosensitive member comprises the substrate 101 and a light receiving layer 102 constituted by a first layer 107 containing at least one kind selected from germanium atoms (Ge) and tin atoms (Sn) and a second layer 108 containing neither germanium atoms nor tin atoms.

That is, the first layer 107 is composed of an a-Si (Ge,Sn)(H,X) material and the second layer 108 is composed of an a-Si(H,X) material.

The electrophotographic photosensitive member of the type as shown in FIG. 1(F) gives excellent various properties by incorporating germanium atoms and/or tin atoms in the first sensitive layer 107. Particularly, it becomes more sensitive to light of wavelengths broadly ranging from short wavelength to long wavelength covering visible light and it also becomes quickly responsive to light.

This effect becomes more significant when a semiconductor laser emitting ray is used as the light source.

The formation of a relevant light receiving layer 102 as explained above on the substrate 101 to prepare the electrophotographic photosensitive member is carried out in accordance with the foregoing procedures in

BEST AVAILABLE COPY which the corresponding substance A and the oxidizing agent are appropriately selected and used.

That is, in the case of forming the layer composed of a-Si(H,X) material, a gaseous or gasifiable silicon hydride (silane) such as $SiH_4$, $Si_2H_6$, $Si_3H_8$ and $Si_4H_{10}$ or a gaseous or gasifiable halogen-substituted silicon hydride (halogenated silane) such as $SiH_3Cl$, $SiH_3F$ and $SiH_3Br$ may be preferably used as the starting substance A.

And as the oxidizing agent in that case, a halogen gas such as $F_2$, $Cl_2$, $Br_2$ and $I_2$ or a nascent state halogen such as nascent state fluorine, chlorine and iodine may be preferably used. And among these substances, $F_2$ gas and $Cl_2$ gas are most preferred.

In the case of forming the layer composed of a-Si(Ge,Sn)(H,X) material, a gaseous or gasifiable substance for introducing germanium atoms or a gaseous or gasifiable substance for introducing tin atoms is selectively used in addition to the above silane gas or halogenated silane gas.

The substance for introducing germanium atoms can include $GeH_4$, $Ge_2H_6$, $Ge_3H_8$, $Ge_4H_{10}$ and $Ge_5H_{12}$. As the substance for introducing tin atoms, there are, for example, tin hydrides such as $SnH_4$.

As the oxidizing agent, any of the foregoing oxidizing agents can be used. And $F_2$ gas or $Cl_2$ gas can be most preferably used.

In the case of forming the layer composed of a-Si(H,X) containing the group III or the group V atoms or the layer composed of a-Si(Ge,Sn)(H,X) containing the group III or the group V atoms, in addition to the above mentioned substance A to be used in the formation of the layer composed of a-Si(H,X) or the layer composed of a-Si(Ge,Sn)(H,X), a gaseous substance containing the group III or the group V atoms as the constituent element is selectively used. And as the oxidizing agent to be used in this case, the same substance as used in the above case is used.

Specifically, usable as the gaseous substance for the group III atoms are, $B_2H_6$, $B_4H_{10}$, $B_5H_9$, $B_6H_{10}$, $B_6H_{12}$, $Al(CH_3)_3$, $Al(C_2H_5)_3$, $Ga(CH_3)_3$ and $In(CH_3)_3$. Among these compounds, $B_2H_6$ is most preferred.

Usable as the gaseous substance for the group V atoms are, for example, $PH_3$, $P_2H_4$, $AsH_3$, $SbH_3$ and $BiH_3$. Among these compounds, $PH_3$ is most preferred.

The gaseous substance either for the group III atoms or for the group V atoms is introduced into a film forming space solely or together with the gaseous substance A such as $SiH_4$ or $Si_2H_6$, chemically contacted with the separately introduced gaseous oxidizing agent therein. And the gaseous substance A and the gaseous substance either for the group III atoms or for the group V atoms are activated by the action of the oxidizing agent to generate plural kinds of precursors containing excited precursors.

Further, in the case of forming the layer composed of a-Si(O,C,N)(H,X), in addition to the foregoing gaseous silane such as $SiH_4$ or $Si_2H_6$ or the foregoing gaseous halogenated silane such as $SiH_3Cl$, $SiH_3F$ or $SiH_3Br$ to be used as the gaseous substance A in the case of forming the layer composed of a-Si(H,X), there is used a gaseous or gasifiable nitrogen compound such as nitrogen ($N_2$), ammonia ($NH_3$), hydrazine ($H_2NNH_2$), hydrogen azide ($HN_3$) and ammonium azide ($NH_4N_3$) or a carbon atom containing compound such as saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

And as the gaseous oxidizing agent, there is used an oxygen containing gas such as air, oxygen ($O_2$) and ozone ($O_3$), a gaseous nitrogen oxide such as dinitrogen oxide ($N_2O$), dinitrogen trioxide ($N_2O_3$) and dinitrogen tetraoxide ($N_2O_4$), a peroxide such as hydrogen peroxide ($H_2O_2$), halogen gas such as $F_2$, $Cl_2$, $Br_2$ and $I_2$, or a nascent state halogen such as nascent state fluorine, chlorine and iodine.

Further in addition, in the case of forming the layer composed of a-Si(O,C,N)(H,X) containing either the group III atoms or the group V atoms, in addition to those gaseous substances to be used as the gaseous substance A in the above case of forming the layer composed of a-Si(O,C,N)(H,X), there is used the gaseous substance either for the group III atoms or for the group V atoms such as $B_2H_6$ gas or $PH_3$ gas.

As the gaseous oxidizing agent, the above mentioned oxygen containing gas, gaseous nitrogen compound, halogen gas can be optionally used.

In the process for preparing an improved electrophotographic photosensitive member according to this invention, the conditions upon forming the photosensitive layer and other layers, for example, the combination of the gaseous substance A with the gaseous oxidizing agent, their mixing ratios, the gas pressure upon mixing those substances in the film forming space, their gas flow rates, the internal pressure upon forming a layer on the substrate, the carrier gas flow rate, the temperature of the substrate and the flow type of each gaseous substance when introduced into the film forming space are important factors for obtaining an appropriate having desired characteristics and they are appropriately selected while considering the functions of the layer to be formed. Further, since these layer forming conditions are organically correlated and may be varied depending upon the kind and the amount of each of the atoms contained in the layer, the conditions are to be determined taking these relationships into consideration.

The volume ratio of the starting substance A to the electronically oxidizing agent on the basis of the flow ratio is preferably 1/100 to 100/1, and more preferably, 1/50 to 50/1.

As for the volume ratio of the gaseous substance for controlling the conductivity to the gaseous substance A on the basis of the flow ratio is preferably $1/10_6$ to 1/10, more preferably, $1/10_5$ to 1/20, and most preferably, $1/10_5$ to 1/50.

The gas pressure in the film forming space when the gaseous substance A is mixed with the gaseous oxidizing agent is preferred to be higher in order to facilitate their chemical contact. But it is necessary to be determined with due regard to their reactivities. Therefore, it is preferably $1\times10^{-7}$ to 10 atmospheric pressure, and more preferably, $1\times10^{-6}$ to 3 atmospheric pressure.

The internal pressure in the film forming space, namely, the pressure of the inner space wherein the substrate is placed is appropriately determined with due regard to the excited precursors to be generated in the above inner space and to the conditions which let those precursors derived from the excited precursors to become effective in forming a deposited layer.

The internal pressure in the film forming space in the case where the reaction region is open-connected to the film forming region can be adjusted with the use of a differential exhausting means or a large scale exhausting device while having due regard to the correlated conditions relating to the introducing pressure and the introducing flow rate for each of the gaseous substance A, the gaseous oxidizing agent and the gaseous substance for controlling the conductivity when they are introduced into the reaction region of the film forming space.

In the case where the conductance of the connecting part between the reaction region and the film forming region is relatively small, the internal pressure in the film forming region can be adjusted by controlling the amount of the exhausting gas by operating an exhausting device being connected to the film forming region.

Further in the case where the reaction region and the film forming region are united and they are not structurally separated, it is desirable to conduct the gas exhaustion with a differential gas exhausting means or with the use of a large scale gas exhausting device.

As above mentioned, the internal pressure in the film forming space is determined while having a due regard on the correlative pressure conditions in introducing the gaseous substance A, the gaseous oxidizing agent and the substance for controlling the conductivity into the film forming space.

However, in general, the internal pressure is preferably, 0.001 to 100 Torr, more preferably, 0.01 to 30 Torr, and most preferably, 0.05 to 10 Torr.

As for the form of the gas flow into the film forming space for each of the foregoing substances, they are appropriately designed with due regard to the geometrical arrangement of the gas flow inlet, the substrate and the gas flow outlet so that the gaseous substance A, the gaseous oxidizing agent and the substance for controlling the conductivity can be effectively introduced into and homogeneously and well mixed in the predetermined region of the film forming space to generate desired precursors and to bring about the effective formation of a deposited film on the substrate.

The temperature of the substrate upon forming a deposited film thereon is properly determined according to the kind of a gaseous substance to be employed and also to the kind of a deposited film to be formed.

That is, in the case of forming a deposited film composed of an amorphous material, it is preferably room temperature to 450° C., more preferably, 50° to 450° C., and, most preferably, 70° to 350° C.

The atmospheric temperature in the film forming space is properly determined with due regard to the temperature of the substrate so that desired precursors are effectively generated, and those precursors as generated and other precursors derived from the former precursors are not changed into undesired things during the film forming process in the film forming space.

Now, description will be hereunder made on an apparatus suitable for practicing the above process for preparing an improved electrophotographic photosensitive member according to this invention referring to the drawings. But the description is not intended to limit the scope of the invention.

Figure 2A:
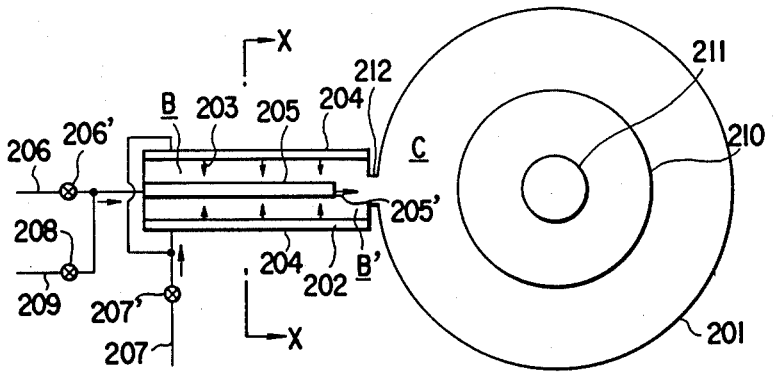
Figure 2B:
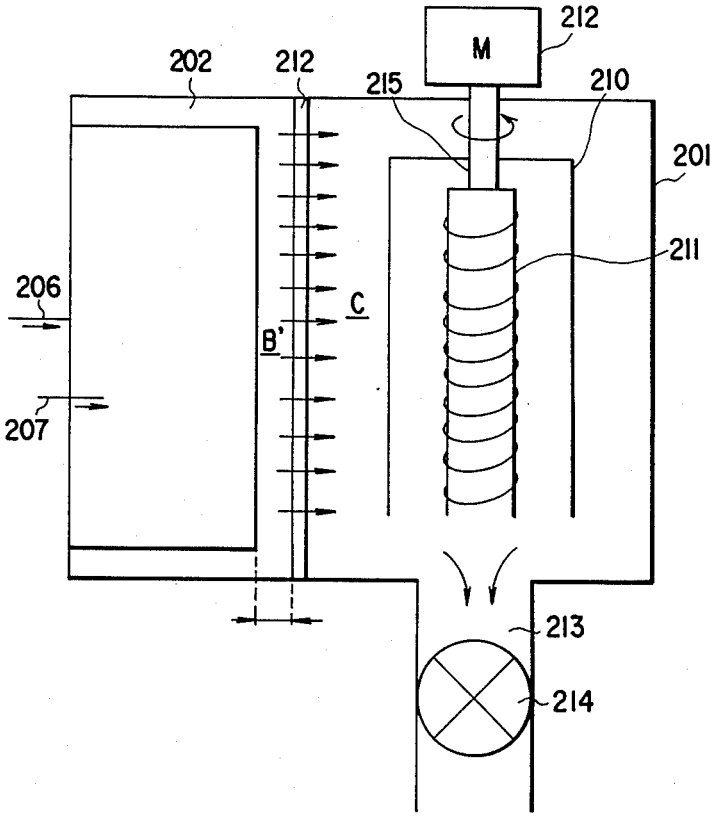
Figure 2C:
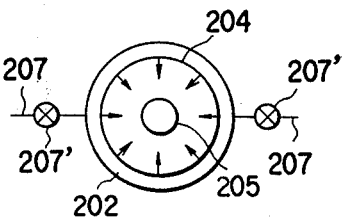

FIGS. 2(A) through 2(C) are schematic diagrams of a representative apparatus for practicing thc process for preparing an electrophotographic photosensitive member according to this invention, in which FIG. 2(A) is a schematic cross-sectional view of the apparatus; FIG. 2(B) is a schematic longitudinal-sectional view of the apparatus; and FIG. 2(C) is a schematic longitudinal-sectional view of the gas transporting conduit of the apparatus.

Figure 3:
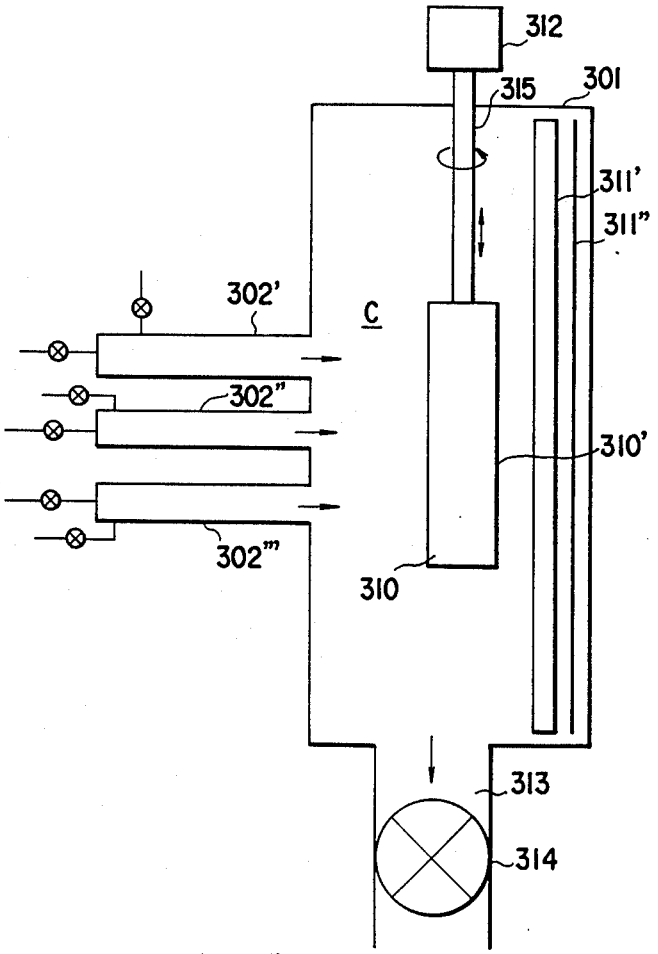
FIG. 3 is a schematic diagram of another representative apparatus for practicing the process for preparing an electrophotographic photosensitive member according to this invention.

FIG. 3 is a schematic diagram of another representative apparatus for practicing the process for preparing an electrophotographic photosensitive member according to this invention.

Referring FIG. 2(A) to FIG. 2(C), film forming chamber 201 has a film forming space C in which substrate holder 211 for substrate 210 in the drum form having electric heater 211' being connected to power source with lead wires (not shown).

The film forming chamber 201 is provided with exhaust pipe 213 being connected through main valve 214 serving to break vacuum in the film forming chamber to an exhaust device (not shown).

Double conduit 204 has gaseous substance A transporting conduit 205 horizontally installed at the middle and gaseous oxidizing agent transporting conduit 202 horizontally provided with the circumferential wall. The double conduit has gaseous oxidizing agent transporting space B between the inner wall face of the conduit 202 and the outer wall face of the conduit 205. The conduit 205 is open at one end adjacent to mixing region B' being situated at the downstream side and connected to the film forming space A through nozzle means or orifice means 212.

The holder 211 for the substrate 210 is suspended from the upper wall of the film forming chamber 201 through rotary shaft 215 being mechanically connected to motor 212 so that the holder 211 can be rotated, lifted or descended by the action of the rotary shaft 215.

The conduit 202 has the plural number gas liberation holes 203 with the inner wall.

The position of the opening 205' of the conduit 205 is situated about 1 to 5 cm distance from the nozzle means 212.

Feeding pipe 206 of the gaseous substance A from a reservoir (not shown) is connected to the conduit 205 through valve means 206'. Feeding pipe 209 of carrier gas is connected to the pipe way of the feeding pipe 206. Feeding pipe 203 of the gaseous oxidizing agent is connected to the conduit 202 through valve means 207'.

Referring FIG. 3, there is shown another representative apparatus for practicing the process for preparing an electrophotographic photosensitive member according to this invention which is provided with three double conduits 302', 302'' and 302'' respectively being of the same structure as the double conduit 204 shown in FIG. 2(A) through FIG. 2(C).

Every double conduit is open at one end to film forming space B of film forming chamber 301 through an appropriate nozzle means (not shown) as in the apparatus shown in FIG. 2(A) through FIG. 2(C).

Holder 310 for substrate 310' in the drum form is suspended from the upper wall of the film forming chamber 301 through rotary shaft 315 being mechanically connected to motor 312 so that the holder 310 can be rotated, lifted or descended by the action of the rotary shaft 315.

The film forming chamber 301 is provided with exhaust pipe 313 being connected through main valve 314 serving to break vacuum in the film forming chamber to an exhaust device (not shown).

In the film forming chamber 301, there are longitudinally installed infrared lamp 311 for heating the substrate 310' and mirror 311' reflecting the infrared radiation toward the substrate 310'.

The advantages of this invention are now described in nore detail by reference to the following Examples, which are provided here for illustrative purposes only, and are not intended to limit the scope of this invention.

EXAMPLE 1

An electrophotographic photosensitive member having a charge injection inhibition layer, a photosensitive layer and a surface layer or a substrate of the type as shown in FIG. 1(E) was prepared using the apparatus shown in FIG. 2(A) through FIG. 2(C).

In this example, the position of the opening 205' of the conduit 205 is adjusted to be about 3 cm distance from the surface of the substrate 210.

An alminum cylinder for electrophotography was used as the substrate 210, and it was firmly disposed onto the holder 211.

The vacuum in the film forming chamber was brought to and maintained at about $10^{-5}$ Torr by regulating the exhaust valve 214.

Then the heater 211' was ignited to heat the cylinder and it was maintained at about 300° C. Concurrently, the motor 212 was started.

Firstly, a charge injection inhibition layer was formed using $F_2$ gas as the gaseous oxidizing agent, $SiH_4$ gas as the gaseous substance A and $B_2H_6$ gas as the gaseous substance for controlling the conductivity.

That is, after confirming the valve 207' on the feeding pipe 207 for the gaseous oxidizing agent was closed, $SiH_4$ gas (100%) and a gas containing 3000 ppm of $B_2H_6$ in He gas (hereinafter referred to as "$B_2H_6$/He gas") were introduced into the film forming space C respectively at a flow rate of 100 SCCM and 100 SCCM. After the flow amount of the gases became stable, the vacuum in the film forming chamber 201 was brought to and maintained at about 0.8 Torr by regulating the exhaust valve 214. Thereafter, $F_2$ gas was introduced into the film forming space C by opening the valve 207' at a flow rate of 15 SCCM.

Wherein, there was observed a strong blue luminescence all over the part near the surface of the cylinder where the gases were mixed.

After 1 hour, it was found that a charge injection inhibition layer composed of a-Si:H:F containing boron atoms was uniformly formed on the cylinder.

Secondly, a photosensitive layer was formed using $SiH_4$ gas, He gas and $F_2$ gas.

That is, the feeding of $F_2$ gas and the feeding of $B_2H_6$/He gas were stopped by closing the corresponding valves, and the feedings of $SiH_4$ gas and He gas were continued at a flow rate of 200 SCCM and 100 SCCM respectively.

After the flow amount of the gases became stable, the vacuum in the film forming chamber 201 was brought to and maintained at 0.8 Torr by regulating the exhaust valve 214.

Thereafter, $F_2$ gas was introduced into the film forming space C at a flow rate of 30 SCCM by opening the valve 207'.

After 4.5 hours, it was found that a photosensitive layer composed of a-Si:H:F of 20 μm in thickness was uniformly formed on the previous charge injection inhibition layer.

Finally, after the valve 207' was closed to stop the feeding of $F_2$ gas, $SiH_4$ gas, He gas and $CH_4$ gas were together introduced into the film forming space C respectively at a flow rate of 50 SCCM, 100 SCCM and 300 SCCM.

After the flow amount of the gases became stable, the vacuum in the film forming chamber 201 was brought to and maintained at 0.8 Torr by regulating the exhaust valve 214.

Then, $F_2$ gas was introduced into the film forming space C.

After 30 minutes, it was found that a surface layer composed of a-SiC:H:F of about 5000 Å in thickness was uniformly formed on the above photosensitive layer.

The feedings of all the gases were terminated by closing the corresponding valves, the heater was switched off, and the vacuum atmosphere in the film forming chamber was released to atmospheric pressure by opening the exhaust valve 214.

After the cylinder 210 being cooled to room temperature, it was taken out from the film forming chamber 201.

When observing the thus obtained electrophotographic photosensitive member, it was found that the member has a wealth of practically applicable many electrophotographic characteristics.

And when examining the thickness and uniformity of the light receiving layer formed on the aluminum cylinder, it was found that the layer is of uniform thickness and of uniform homogeneity.

EXAMPLE 2

An electrophotographic photosensitive member having a charge injection inhibition layer, a photosensitive layer and a surface layer on a substrate of the type as shown in FIG. 1(E) was prepared using the apparatus shown in FIG. 3.

An aluminum cylinder for electrophotography as the substrate 310' was firmly disposed onto the holder 310.

Then, the vacuum in the film forming chamber 301 was brought to and maintained at about $10^{-5}$ Torr by regulating the exhaust valve 314.

Concurrently, the infrared lamp 311 was switched on to uniformly heat the cylinder to 290° C. and it was maintained at that temperature.

And the position of the holder 310 was changed so as to adjust the top level of the cylinder to be situated under the opening of the double conduit 302''', then the gaseous substances as the gaseous substance A and He gas were respectively introduced into the film forming space C of the film forming chamber 301 through the double conduits 302', 302'' and 302''' under the conditions shown in Table 1.

After the flow amount of each gas became stable, the vacuum in the film forming chamber 301 was brought to and maintained at about 0.8 Torr by regulating the exhaust valve 314.

Thereafter, $F_2$ gas as the gaseous oxidizing agent was introduced into the film forming space C through the double conduits 302', 302'' and 302''' under the conditions shown in Table 1.

Wherein, there was observed a strong blue luminescence in the region ranging from the openings of the double conduits to the surface of the cylinder.

While maintaining the above state, the cylinder was lifted at a speed of 1.0 mm/minute while being rotated by the action of the rotary shaft 315.

The film forming rate for the corresponding layer was as shown in Table 1.

In this way, there was formed firstly a charge injection inhibition layer composed of a-Si:H:F containing boron atoms of about 2 μm in thickness, secondly a photosensitive layer composed of a-Si:H:F of about 20 μm in thickness and finally a surface layer composed of a-SiC:H:F of about 0.5 μm in thickness on the cylinder.

The feedings of all the gases were terminated by closing the corresponding valves, the infrared lamp was switched off, and the vacuum atmosphere in the film forming chamber was released to atmospheric pressure by opening the exhaust valve 314.

After the cylinder being cooled to room temperature, it was taken out from the film forming chamber 301.

When observing the thus obtained electrophotographic photosensitive member, it was found that the member has a wealth of practically applicable many electrophotographic characteristics.

And when examining the thickness and uniformity of the light receiving layer formed on the aluminum cylinder, it was found that the layer is of uniform thickness and of uniform homogeneity.

TABLE 1

| Gas introducing conduit | Gaseous substance A (SCCM) | Gaseous oxidizing agent (SCCM) | Carrier gas (SCCM) | Film forming rate (Å/sec) |
|---|---|---|---|---|
| | $SiH_4$ = 100 | | | |
| 302' | $CH_4$ = 300 | $F_2$ = 20 | He = 100 | 0.25 |
| 302" | $SiH_4$ = 900 | $F_2$ = 90 | He = 800 | 10 |
| | $SiH_4$ = 300 | | | |
| 302''' | $B_2H_6$/He (1500 ppm) = 100 | $F_2$ = 30 | He = 150 | 1 |

EXAMPLE 3

A light receiving layer was formed on an aluminium cylinder in the same manner as in Example 1 with the film forming conditions shown in Table 2.

When observing the thus obtained electrophotographic photosensitive member, it was found that the member has a wealth of practically applicable many electrophotographic characteristics.

And when examining the thickness and uniformity of the light receiving layer formed on the aluminum cylinder, it was found that the layer is of uniform thickness and of uniform homogeneity.

TABLE 2

| Constituent Layer | Gaseous substance A (SCCM) | Gaseous oxidizing agent (SCCM) | Carrier Gas (He) (SCCM) | Layer thickness |
|---|---|---|---|---|
| Charge injection inhibition layer | $SiH_4$ = 300<br>$B_2H_6$/He (1500 ppm) = 100 | $O_2$ = 30 | 150 | 3000Å |
| Photo-sensitive layer | $SiH_4$ = 900 | $O_2$ = 100 | 450 | 10μ |
| Surface layer | $SiH_4$ = 100<br>$CH_4$ = 300 | $O_2$ = 10 | 50 | 1000Å |

Temperature of substrate: 250° C.
The vacuum in the film forming chamber: 1.0 Torr

EXAMPLE 4

A light receiving layer was formed on an aluminium cylinder in the same manner as in Example 2 with the film forming conditions shown in Table 3.

When observing the thus obtained electrophotographic photosensitive member, it was found that the member has a wealth of practically applicable many electrophotographic characteristics.

And when examining the thickness and uniformity of the light receiving layer fomred on the aluminum cylinder, it was found that the layer is of uniform thickness and of uniform homogeneity.

TABLE 3

| Gas introducing conduit | Gaseous substance A (SCCM) | Gaseous oxidizing agent (SCCM) | Carrier gas (He gas) (SCCM) | Film forming rate (Å/sec) |
|---|---|---|---|---|
| | $SiH_4$ = 200 | | | |
| 302' | $CH_4$ = 400 | $O_2$ = 50 | 50 | 0.2 |
| 302" | $SiH_4$ = 1500 | $O_2$ = 300 | 300 | 2 |
| | $SiH_4$ = 600 | | | |
| 302''' | $B_2H_6$/He (1500 ppm) = 200 | $O_2$ = 60 | 60 | 0.05 |

Temperature of substrate: 250° C.
The vacuum in the film forming chamber: 1.0 Torr

What we claim is:

1. In the process for preparing an improved electrophototgraphic photosensitive member having a substrate and a light receiving layer comprising a layer formed from a silicon-containing amorphous material, the improvement which comprises:

(a) introducing via a first gas transportation conduit into an evacuated film-forming space having said substrate therein; a gaseous substance (i) capable of being a constituent for said layer, but essentially incapable of contributing to the formation of said layer in its original energy state and, separately, through a second gas transportation conduit concentric with the first gas transportation conduit, a gaseous oxidizing agent (ii) capable of electronically oxidizing the substance (i); said first and second concentric gas transportation conduits having outlets terminating adjacent said film-forming space to form a mixing region for said substances (i) and (ii);

(b) chemically reacting said two gaseous substances (i) and (ii) in the absence of a plasma in the space surrounding the surface of said substrate in said film-forming space; said substrate being maintained at an elevated temperature to generate a plurality of precursors containing excited precursors and to cause at least one of the precursors to form said layer; and simultaneously rotating said substrate; and (c) maintaining the length between the outlets of said first and second concentric gas transportation conduits forming said mixing region from about 1 to 5 centimeters.

2. The process for preparing an improved electrophotographic photosensitive member according to claim 1, wherein the gaseous substance (i) contains a substance for controlling the conductivity.

3. The process for preparing an improved electrophotographic photosensitive member according to claim 1, wherein the formation of said layer is carried out in a luminescent atmosphere.

4. The process for preparing an improved electrophotographic photosensitive member according to claim 1, wherein the gaseous substance (i) is a gaseous silane.

5. The process for preparing an improved electrophotographic photosensitive member according to claim 1, wherein the gaseous substance (i) is a gaseous substance containing at least one member selected from germanium compounds and tin hydrides.

6. The process for preparing an improved electrophotographic photosensitive member according to claim 1, wherein the gaseous substance (i) is a gaseous substance containing a hydrocarbon compound.

7. The process for preparing an improved electrophotographic photosensitive member according to claim 1, wherein the gaseous oxidizing substance (ii) is a gaseous halogenic substance selected from the group consisting of halogen gases and nascent state halogens.

8. The process for preparing an improved electrophotographic photosensitive member according to claim 1, wherein the gaseous oxidizing substance (ii) is a gaseous oxygen substance.

9. The process for preparigg an improved electrophotographic photosensitive member according to claim 1, wherein the gaseous oxidizing substance (ii) is gaseous nitrogen substance.

10. The process for preparing an improved electrophotographic photosensitive member according to claim 1, wherein said silicon containing amorphous material contains at least one kind selected from hydrogen atoms and halogen atoms.

11. The process for preparing an improved electrophotographic photosensitve member according to claim 1, wherein said light receiving layer contains a photoconductive layer containing silicon atoms and at least one kind selected from germanium atoms and tin atoms.

12. The process for preparing an improved electrophotographic photosensitive member according to claim 1, wherein said light receiving layer contains a photoconductive layer containing silicon atoms, at least one kind selected from germanium atoms and tin atoms, and at least one kind selected from hydrogen atoms and halogen atoms.

13. The process for preparing an improved electrophotographic photosensitive member according to claim 1, wherein said light receiving layer is of a multilayered structure having a photoconductive layer as one of the constituent layers.

14. The process of preparing an improved electrophotographic photosensitive member according to claim 13, wherein said light receiving layer contains a charge injection inhibition layer containing a substance to control the conductivity as one of the constituent layers.

15. The process for preparing an improved electrophotographic photosensitive member according to claim 13, wherien said light receiving layer contains a layer containing at least one kind selected from oxygen atoms, carbon atoms and nitrogen atoms as one of the constituent layers.

16. The process for preparing an improved electrophotographic photosensitive member according to claim 13, wherein said light receiving layer contains a surface layer containing at least one kind selected from oxygen atoms, carbon atoms and nitrogen atoms as one of the constituent layers.

17. The process for preparing an improved electrophotographic photosensitive member according to claim 14, wherein said light receiving layer further contains a surface layer containing at least one kind selected from oxygen atoms, carbon atoms and nitrogen atoms as one of the constituent layers.

18. The process for preparing an improved electrophotographic photosensitive member according to claim 13, wherein said light receiving layer contains a layer containing at least one kind selected from germanium atoms and tin atoms and another layer containing neither germanium atoms nor tin atoms in this order from the side of said substrate.

19. The process for preparing an improved electrophotographic photosensitive member according to claim 14, wherein said light receiving layer further contains a layer containing at least one kind selected from germanium atoms and tin atoms and another layer containing neither germanium atoms nor tin atoms in this order from the side of the substrate.

20. The process for preparing an improved electrophotographic photosensitive member according to claim 15, wherein said light receiving layer further contains a layer containing at least one kind selected from germanium atoms and tin atoms and another layer containing neither germanium atoms nor tin atoms in this order from the side of the substrate.

21. The process for preparing an improved electrophotographic photosensitive member according to claim 16, wherein said light receiving layer still futher contains a layer containing at least one kind selected from germanium atoms and tin atoms and another layer containing neither germanium atoms nor tin atoms in this order from the side of the substrate.

22. The process for preparing an improved electrophotographic photosensitive member according to claim 17, wherein said light receiving layer still further contains a layer containing at least one kind selected from germanium atoms and tin atoms and another layer containing neither germanium atoms nor tin atoms in this order from the side of the substrate.

* * * * *

UNITED STATES PATENT AND TRADEMARK OFFICE

CERTIFICATE OF CORRECTION

PATENT NO. : 4,855,210

DATED : August 8, 1989

INVENTOR(S) : MASAAKI HIROOKA, ET AL.

It is certified that error appears in the above-identified patent and that said Letters Patent is hereby corrected as shown below:

COLUMN 1

Line 46, "are" should be deleted.

COLUMN 4

Line 65, "the" should read --be--.

COLUMN 7

Line 35, "semiconductora" should read --semiconductors--.

COLUMN 12

Line 54, "$1/10_6$ to 1/10," should read --$1/10^6$ to 1/10,--.
Line 55, "$1/10_5$ to 1/20," should read --$1/10^5$ to 1/20,--.
Line 56, "$1/10_5$ to 1/50." should read --$1/10^5$ to 1/50.--.

UNITED STATES PATENT AND TRADEMARK OFFICE

CERTIFICATE OF CORRECTION

PATENT NO. : 4,855,210

DATED : August 8, 1989

INVENTOR(S) : MASAAKI HIROOKA, ET AL.

It is certified that error appears in the above-identified patent and that said Letters Patent is hereby corrected as shown below:

COLUMN 19

Line 52, "preparigg" should read --preparing--.

Signed and Sealed this

Third Day of December, 1991

*Attest:*

HARRY F. MANBECK, JR.

*Attesting Officer*

*Commissioner of Patents and Trademarks*